US011127228B1

(12) United States Patent
Brown et al.

(10) Patent No.: US 11,127,228 B1
(45) Date of Patent: Sep. 21, 2021

(54) INTERACTIVE SENSOR, COMMUNICATIONS, AND CONTROL SYSTEM FOR A UTILITY VEHICLE

(71) Applicant: Hydro-Gear Limited Partnership, Sullivan, IL (US)

(72) Inventors: Alyn G. Brown, Indianapolis, IN (US); David H. Dunten, Whitestown, IN (US)

(73) Assignee: Hydro-Gear Limited Partnership, Sullivan, IL (US)

( * ) Notice: Subject to any disclaimer, the term of this patent is extended or adjusted under 35 U.S.C. 154(b) by 0 days.

(21) Appl. No.: 16/441,684

(22) Filed: Jun. 14, 2019

Related U.S. Application Data

(62) Division of application No. 14/918,465, filed on Oct. 20, 2015, now Pat. No. 10,629,005.

(60) Provisional application No. 62/066,171, filed on Oct. 20, 2014.

(51) Int. Cl.
*G07C 5/00* (2006.01)

(52) U.S. Cl.
CPC ..... *G07C 5/008* (2013.01)

(58) Field of Classification Search
CPC ..... G05D 1/027; G05D 1/028
See application file for complete search history.

(56) References Cited

U.S. PATENT DOCUMENTS 4,600,999 A 7/1986 Ito et al.
4,700,301 A 10/1987 Dyke
4,962,453 A 10/1990 Pong et al.
5,163,273 A 11/1992 Wojtkowski et al.
5,204,814 A 4/1993 Noonan et al.
5,528,888 A 6/1996 Miyamoto et al.
5,911,670 A 6/1999 Angott et al.
(Continued)

FOREIGN PATENT DOCUMENTS

DE 19645723 5/1997
DE 102007008910 8/2008
(Continued)

OTHER PUBLICATIONS

Danfoss Telematics Solutions, "Using data to drive efficiency and profit," Danfoss A/S Brochure, Nov. 2014.
(Continued)

*Primary Examiner* — Imran K Mustafa
(74) *Attorney, Agent, or Firm* — Neal, Gerber & Eisenberg LLP

(57) ABSTRACT

A system for remotely controlling mower operations includes a mower and a remote server. The mower includes a plurality of wheels and a plurality of blades. The mower also includes an onboard processor configured to control operation of the mower and a transceiver configured to communicate with the mobile device via a wireless area network. The remote server is configured to communicate with the mobile device via a cellular network to receive real-time streaming of a GPS location collected from a GPS unit of the mobile device. The remote server also is configured to determine, in real-time, a command signal for the mower based on the GPS location and transmit, in real-time, the command signal to the onboard processor via the mobile device to instruct the onboard processor to modify one or more mower operational parameters.

18 Claims, 5 Drawing Sheets

(56) References Cited

U.S. PATENT DOCUMENTS 5,925,080 A 7/1999 Shimbara et al.
5,974,347 A 10/1999 Nelson
6,009,358 A 12/1999 Angott et al.
6,052,647 A 4/2000 Parkinson et al.
6,101,795 A 8/2000 Diekhans
6,112,143 A 8/2000 Allen et al.
6,128,574 A 10/2000 Diekhans
6,321,158 B1 11/2001 DeLorme et al.
6,339,736 B1 1/2002 Moskowitz et al.
6,519,290 B1 2/2003 Green
6,611,755 B1 8/2003 Coffee et al.
6,629,029 B1 9/2003 Giles
6,738,697 B2 5/2004 Breed
7,089,721 B2 8/2006 Turner et al.
7,172,041 B2 2/2007 Wuertz et al.
7,356,393 B1 4/2008 Schlatre et al.
7,367,496 B2 5/2008 Karstens
7,415,333 B2 8/2008 Anderson
7,503,173 B2 3/2009 Dong et al.
7,581,603 B2 9/2009 Hammonds
7,610,122 B2 10/2009 Anderson
7,640,092 B2 12/2009 Dammann
7,660,652 B2 2/2010 Smith et al.
7,725,129 B2 5/2010 Grunhold
7,904,219 B1 3/2011 Lowrey et al.
7,912,641 B2 3/2011 Osentoski et al.
7,925,433 B2 4/2011 Smith et al.
7,944,185 B2 5/2011 Jabaji et al.
7,953,526 B2 5/2011 Durkos et al.
8,239,083 B2 8/2012 Durkos et al.
8,600,432 B2 12/2013 Krupnik
8,645,016 B2 2/2014 Durkos et al.
8,688,313 B2 4/2014 Margol et al.
8,706,297 B2 4/2014 Letsky
8,880,291 B2 * 11/2014 Hampiholi ..... B60R 25/25 701/36
8,918,230 B2 12/2014 Chen et al.
8,954,006 B2 2/2015 Alrabady
8,983,713 B2 3/2015 Shinohara et al.
9,014,888 B2 4/2015 Sukkarié et al.
9,026,267 B2 5/2015 Schwarz et al.
9,043,106 B2 5/2015 Ingram et al.
9,047,170 B2 6/2015 Naboulsi
9,063,211 B2 6/2015 Anderson et al.
9,114,798 B1 8/2015 Fox et al.
9,251,627 B2 2/2016 Carl
9,308,643 B2 4/2016 Dooley et al.
9,308,892 B2 4/2016 Schwarz et al.
2003/0144774 A1 7/2003 Trissel et al.
2004/0085198 A1 5/2004 Saito et al.
2004/0220707 A1 11/2004 Pallister
2005/0206226 A1 9/2005 Lu et al.
2006/0010844 A1 1/2006 Angott
2006/0012144 A1 1/2006 Kunzler et al.
2006/0020369 A1 1/2006 Taylor et al.
2006/0059880 A1 3/2006 Angott
2006/0155437 A1 7/2006 Wang et al.
2006/0180375 A1 8/2006 Wierzba et al.
2006/0190162 A1 8/2006 Ampunan et al.
2007/0021885 A1 1/2007 Soehren
2008/0027590 A1 1/2008 Phillips et al.
2008/0085689 A1 * 4/2008 Zellner ..... H04W 4/80 455/187.1
2008/0294288 A1 11/2008 Yamauchi
2009/0000839 A1 1/2009 Ishii et al.
2009/0065273 A1 * 3/2009 Wyatt ..... B60W 30/1886 180/65.8
2010/0073158 A1 3/2010 Uesaka et al.
2010/0151917 A1 6/2010 Wilson
2010/0161171 A1 6/2010 Valentine et al.
2010/0207754 A1 8/2010 Shostak et al.
2010/0268402 A1 10/2010 Schwarz et al.
2011/0295636 A1 12/2011 Anderson
2012/0028680 A1 2/2012 Breed
2012/0239223 A1 * 9/2012 Schwarz ..... B60R 25/04 701/2
2012/0320891 A1 12/2012 Moeller
2013/0038692 A1 * 2/2013 Ohtomo ..... G05D 1/0016 348/46
2013/0041526 A1 2/2013 Ouyang
2013/0304349 A1 11/2013 Davidson
2014/0013722 A1 1/2014 Pitcel et al.
2014/0032062 A1 1/2014 Baer et al.
2014/0172197 A1 6/2014 Ganz et al.
2014/0244001 A1 8/2014 Glickfield et al.
2014/0360399 A1 12/2014 Rees et al.
2015/0025755 A1 1/2015 Willgert et al.
2015/0061828 A1 3/2015 Fischer et al.
2015/0112542 A1 4/2015 Fuglewicz
2015/0112800 A1 * 4/2015 Binion ..... G06Q 30/0255 705/14.53
2015/0204758 A1 7/2015 Schnell et al.
2015/0248131 A1 * 9/2015 Fairfield ..... G05D 1/0038 701/2
2015/0355637 A1 * 12/2015 Morisset ..... G05D 13/02 701/2
2016/0073275 A1 3/2016 Inoue et al.
2016/0087554 A1 3/2016 Nohra
2016/0226369 A1 8/2016 McMahon et al.
2017/0168501 A1 * 6/2017 Ogura ..... G05D 1/0038

FOREIGN PATENT DOCUMENTS

DE 102010020537 11/2011
DE 102010041309 3/2012
EP 2870852 5/2015
EP 2926642 10/2015
JP 10-006890 1/1998
JP H10-011142 1/1998
WO WO2007084965 7/2007
WO WO2010077198 7/2010
WO WO2013025884 2/2013
WO WO2013025890 2/2013
WO WO2013025910 2/2013
WO WO2013100938 7/2013
WO WO2013102023 7/2013
WO WO2013134615 9/2013
WO WO2013134709 9/2013
WO WO2013134715 9/2013
WO WO2013134721 9/2013
WO WO2015022672 2/2015

OTHER PUBLICATIONS

Getting Started with OnStar, OnStar Owner's Guide, Jul. 2011.
Guidance Systems, John Deere Brochure, Apr. 2013.
John Deere JDLink Brochure, Sep. 2015.
John Deere WorkSight Brochure, Jul. 2015.
Lutz, et al., "Remote Controls on a Zero-Turn Commercial Lawn Mower to Conduct SAE J2194 Rollover Tests," An ASAE Meeting Presentation, Paper No. 055004, Jul. 17-20, 2005.
Mika, "Telematics '13: Panoramic Fleet Management," Automotive Fleet, Aug. 21, 2015.
Smith, et al., "Design and Implementation of a Control Algorithm for an Autonomous Lawnmower," IEEE 0/7803-9197, Jul. 2005.
Spencer, "The Development of an Autonomous Vehicle for Use in Agriculture," A thesis submitted to the Graduate Faculty of North Carolina State University, 2004.
Toro, myTurf Fleet Management System Brochure, The Toro Company, 2014.
U.S. Appl. No. 14/693,255, filed Apr. 22, 2015.
U.S. Appl. No. 14/693,255, filed Apr. 22, 2015 a copy of which is not being furnished herewith, pursuant to the Commissioner's Notice dated Sep. 21, 2004.

* cited by examiner

INTERACTIVE SENSOR, COMMUNICATIONS, AND CONTROL SYSTEM FOR A UTILITY VEHICLE

CROSS-REFERENCE TO RELATED APPLICATIONS

This application is a divisional of U.S. Non-Provisional patent application Ser. No. 14/918,465, filed on Oct. 20, 2015, which claims the benefit of U.S. Provisional Patent Application No. 62/066,171, filed on Oct. 20, 2014. These prior applications are incorporated herein by reference in their entirety.

TECHNICAL FIELD

The present invention relates to utility vehicles, and more particularly to an interactive sensor, communications, and control system for utility vehicles such as zero turn radius lawnmowers, autonomous ground maintenance equipment and the like.

BACKGROUND

Zero turn radius utility vehicles exist today in a wide variety of forms and types with lawnmowers being among the more common. Typically, the propulsion system for a zero turn radius lawnmower includes an internal combustion engine. The output from the internal combustion engine is then coupled to one or more pulleys for turning at least two different drive systems that are driven by the rotary output of the engine.

The primary drive system of the internal combustion engine is the vehicle traction driver that is responsible for moving the vehicle by converting the rotary output of the internal combustion engine into rotary movement of the vehicle's wheels. The output shaft of the engine is coupled (usually via a pulley) to the input shaft of a hydraulic pump, which is part of a hydrostatic transmission. The hydrostatic transmission uses the flow of pumped fluids to ultimately turn a gear train that turns the driven wheels of the lawnmower. The secondary drive system is usually a tool driver that includes a pulley that drives a tool such as the blades of a lawnmower. Other tools driven by the tool driver system can include snow blowers, tillers, brushes and the like.

A zero turn vehicle may use a single hydrostatic transmission with two independently controllable outputs, or two separate hydrostatic transmissions with separate pumps and separate outputs. By independently controlling the first and second outputs, one can independently control the operation of the first and second driven wheels.

For example, driving the driven wheels at the same speed in the same direction will cause the lawnmower to generally move in a straight line. However, by varying the relative speed of the right and left driven wheels, one can cause the vehicle to turn as a result of this difference in speed. If the wheels are rotated so that one wheel, such as the right wheel, is driven forward and the other wheel, such as the left wheel, is driven in reverse, the vehicle will turn on its axis, and as such, have a "zero turn radius" that gives the name to this particular type of utility vehicle.

Another type of propulsion system is a hybrid propulsion system, wherein an internal combustion engine is provided whose primary purpose is to drive an alternator to thereby generate electricity. The electricity so generated is stored in a storage battery. Electricity from the storage battery is then directed to one or more electric motors. The electric motors are operatively coupled to the driven wheels through a gear reduction member so that the rotation of each motor rotates a driven wheel.

Utility vehicles of the type described above have been used for many years with generally acceptable results. Nonetheless, room for improvement exists. As with any mechanical device, they are subject to breakdown and require periodic maintenance. Additionally, many utility vehicles are used as a part of a fleet of devices that are operated by mowing contractors, golf courses, businesses, landlords, universities, municipalities and the like. The use of such utility vehicles involves management issues relating to scheduling the proper utility vehicle for the job for which it is being used, scheduling operators for the utility vehicles, and performing maintenance on the utility vehicles.

A factor that exacerbates the management issues is the fact that the utility vehicles are being operated in the field at the location of the customer, rather than being operated close to the company's headquarters. As such, it is often difficult for management to maintain good oversight on events that are transpiring during the operation of the utility vehicles.

As such, one embodiment disclosed herein provides a communications system that is operable between a device and a device operator, and also, potentially between the device operator and a remote location. The communication system can enable an owner and/or operator of a device to monitor the condition and operational parameters of the particular device even when the device is operated remotely.

SUMMARY

In accordance with one embodiment of the present application, a monitoring system is provided for a utility vehicle, and in particular, a zero turn radius type utility vehicle such as a lawnmower. The monitoring system includes a processor and one or more sensors that are in communication with the processor, to report on various sensed parameters of the utility vehicle to the processor.

The processor can include an onboard processor having a transmitter for transmitting information received from onboard sensors. The information can be processed by the processor and then transmitted to a near range electronic device, such as a mobile phone, a computer, a portable computing device, and the like. This communication can occur through either a Bluetooth or Wi-Fi type connection. The near range electronic device also includes a transmitter that is capable of transmitting information to a far range electronic device, such as a remote computer, that may be positioned at a location such as a fleet supervision center, a user's home, or a service center for monitoring the maintenance of the utility vehicle.

Another embodiment of the present application includes a data gathering system for gathering information about the operation of a device such as a lawnmower or other utility vehicle and a communication system for communicating sensed information to a remote location, such as a supervision center, home computer or service center. This embodiment can enable other operators who are spatially separated from the device to monitor the activities of the device. For example, by transferring the information to a fleet supervision center, a supervisor of the fleet of devices can obtain real time information about the operation of the device and the maintenance state of the device.

This not only helps the fleet supervisor manage the operation and maintenance of the utility device, but also helps to manage the personnel operating the device. For example, if the information conveyed to the remote supervisor includes geo-location information, the supervisor can help determine whether the operator is on the correct site and whether the operator is actually operating the device on the site.

In another embodiment, the operational parameters of the device, such as oil pressure, tire pressure, engine hours, etc., can be transmitted to a remote facility, such as a service facility, so the service facility can have near real time information about the operating parameters and condition of the device; or, alternately, can monitor the device to either diagnose breakdowns or to be able to schedule maintenance activities for the device.

These and other features of the present application will be appreciated by those skilled in the art upon a review of the drawings and detailed description presented below.

DETAILED DESCRIPTION OF THE DRAWINGS

Figure 1:
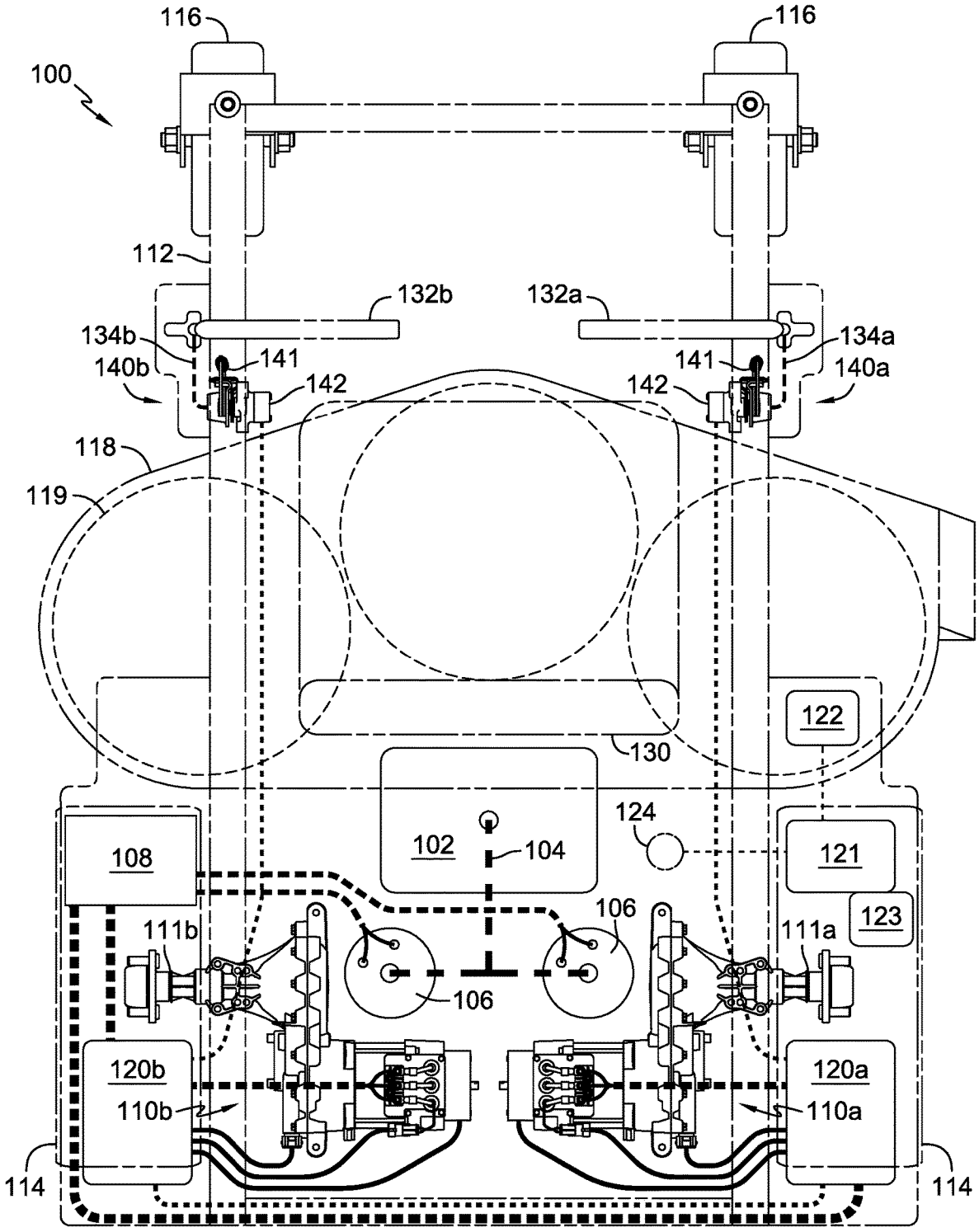
FIG. 1 is a partially schematic plan view of an exemplary hybrid utility vehicle, namely a zero turn radius lawnmower, incorporating components of a monitoring system as disclosed herein.
Figure 2:
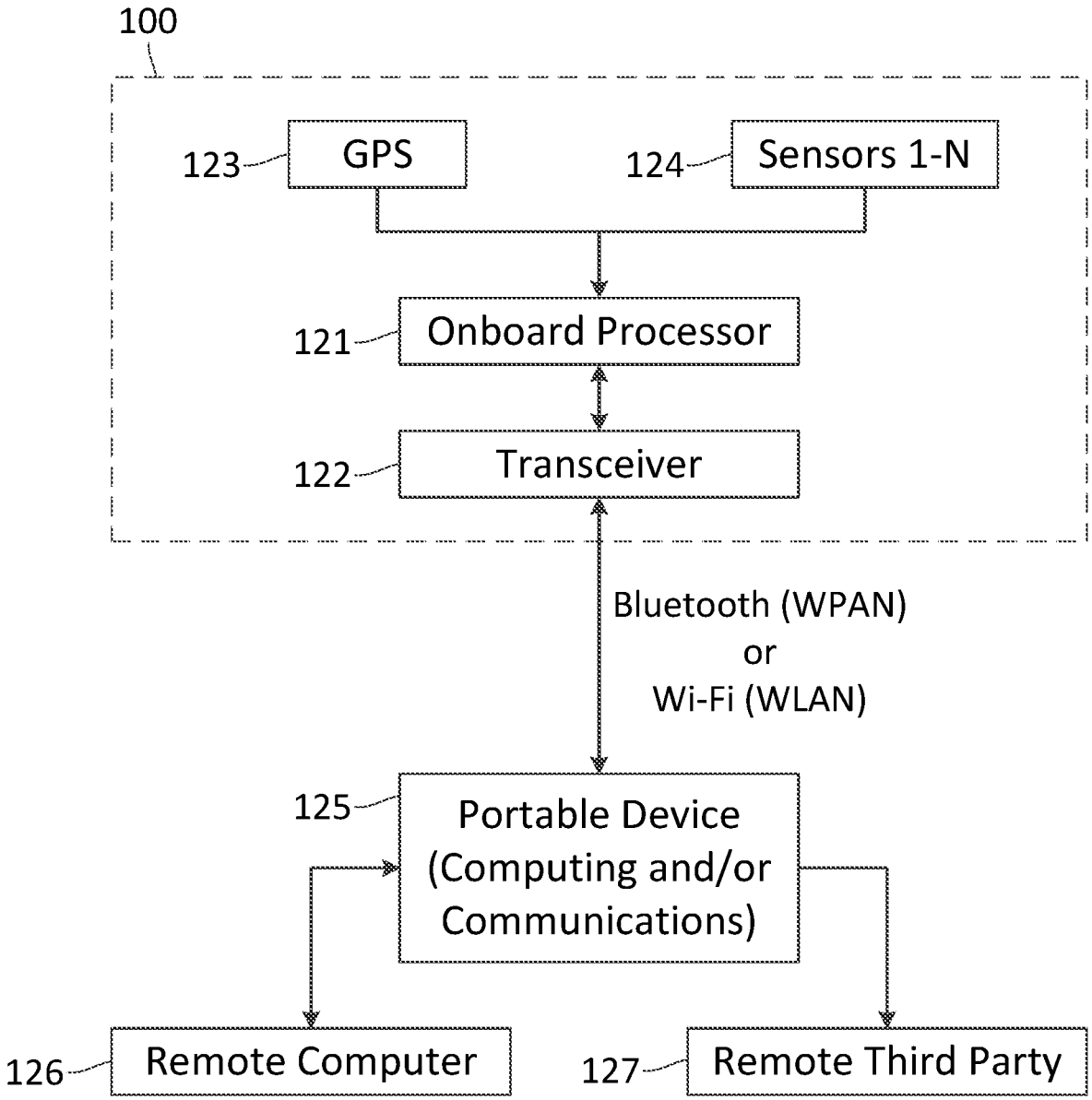
FIG. 2 is a diagram illustrating components of one embodiment of a monitoring system disclosed herein that can be used in conjunction with the vehicle of FIG. 1.

The description that follows describes, illustrates and exemplifies one or more particular embodiments of the present application in accordance with its principles. This description is not provided to limit the invention to the embodiment(s) described herein, but rather to explain and teach the principles of the invention in such a way to enable one of ordinary skill in the art to understand these principles and, with that understanding, be able to apply them to practice not only the embodiment(s) described herein, but also other embodiments that may come to mind in accordance with these principles. The scope of the present application is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing reference numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose. The present specification is intended to be taken as a whole and interpreted in accordance with the principles of the present application as taught herein and understood by one of ordinary skill in the art.

FIG. 1 depicts an embodiment of a zero turn hybrid utility vehicle 100, which by way of example only is a riding lawnmower. Various components of vehicle 100 can be mounted on and supported by a frame 112. In particular, an engine 102, one or more alternators 106, a battery 108, a set of electric zero turn transaxles 110*a*, 110*b*, and traction controllers 120*a*, 120*b* can be mounted on frame 112. Frame 112 also supports a deck 118, which may be of fixed height (relative to ground), ground-following, or height adjustable as known in the art. Deck 118 can include mowing blades 119 and is intended to be representative of not only blades, but other ground engaging equipment such as brush cutters, aerators, and the like. An operator seat 130 is positioned above deck 118 and is also affixed to frame 112. Frame 112 is supported above ground by a pair of caster wheels 116 and a pair of driven wheels 114.

Engine 102, such as a gasoline or diesel type internal combustion engine, drives the alternator(s) 106 via a belt and pulley assembly 104. Alternators 106 generate electric power to charge the battery 108, and it will be understood that alternator(s) 106 can be replaced with one or more generators. Battery 108 supplies electric power to a set of electric zero turn transaxles 110*a*, 110*b*. Electric zero turn transaxles 110*a*, 110*b* provide rotational output through a pair of output shafts 111*a*, 111*b* to rotationally drive the driven wheels 114.

Traction controllers 120*a*, 120*b* can control the speed and direction of driven wheels 114 by controlling respective electric zero turn transaxles 110*a*, 110*b*, based on inputs from an operator (sitting in operator seat 130). Traction controllers 120*a*, 120*b* are mounted near the rear of vehicle 100 near electric zero turn transaxles 110*a*, 110*b* away from engine 102 to aid in cooling, although other locations are possible. The operator can provide speed and direction inputs through a pair of drive levers 132*a*, 132*b*. Drive levers 132*a*, 132*b* can connect to a pair of control assemblies 140*a*, 140*b* via corresponding mechanical linkages 134*a*, 134*b*. Control assemblies 140*a*, 140*b* can each include a mechanical return to neutral (RTN) mechanism 141 and a potentiometer 142 to communicate the position of drive levers 132*a* and 132*b* to traction controllers 120*a* and 120*b* respectively.

Based on the position of drive levers 132*a*, 132*b*, potentiometers 142 can provide varying inputs to traction controllers 120*a*, 120*b* so that electric zero turn transaxles 110*a*, 110*b* (and driven wheels 114) are driven as desired by the operator. In the absence of inputs from the operator, RTN mechanisms 141 can force drive levers 132*a*, 132*b* to a neutral position. Front caster wheels 116 react in response to the actions of rear driven wheels 114.

Internal combustion engine 102 contains a downwardly extending output shaft (not shown), which can serve two functions. The first function can be driving a generator or alternator 106 that generates electricity for operating electric zero turn transaxles 110*a*, 110*b* that drive driven wheels 114 of utility vehicle 100. A second function can include driving a rotatable accessory output device, tool, implement or attachment, such as rollers, brushes, tillers, spreaders, sprayers or other power driven accessories.

A common feature shared by many of the mower attachments is that they are driven by a belt that is coupled to the output shaft of internal combustion engine 102. The rotation of engine 102 turns a pulley that, through a belt, drives the accessory devices, such as blades 119.

Energy that is stored in battery 108 is then delivered by wiring to traction controllers 120*a*, 120*b* that control the current from battery 108, and direct the current to the proper components of utility vehicle 100.

The transaxle arrangement shown in FIG. 1 contemplates a single transaxle being used for each of two driven wheels 114 of a four wheel vehicle. In other embodiments, other numbers and ratios of transaxles to driven wheels are contemplated. Additional details of a vehicle similar in many respects to vehicle 100 can be found in commonly owned U.S. patent application Ser. No. 14/693,255, now U.S. Pat. No. 9,499,199, the disclosure of which is incorporated herein by reference.

Each of the electric zero turn transaxles 110*a*, 110*b* includes an electric motor and a gear box that, in most cases, would comprise a reduction gear box to maximize the efficiency of the electric motor. The gear boxes are coupled to their respective driven wheels 114. It will be understood that such gear boxes are not necessary in all situations, and the internal details of such gear boxes are known to persons of skill in the art.

An interactive sensor communication and control system for a vehicle such as utility vehicle 100 is shown in FIGS. 2-5. A utility vehicle, such as the zero turn radius lawnmower 100 of FIG. 1, is provided that includes an onboard transceiver 122, a GPS unit 123 and a plurality of sensors 124. The GPS unit 123 is provided for serving as a geolocation device for vehicle 100, so that the location of vehicle 100 can be determined at any particular time. A plurality of sensors 124 is provided for sensing various conditions and parameters of vehicle 100. The various sensors 124 will be discussed in more detail with respect to FIG. 3 below.

An onboard processor 121 is provided for processing the various data streams fed to it by the sensors 124 and the GPS unit 123. Output from potentiometers 142, such as an indication of drive levers 132*a*, 132*b* positioned at neutral, for example, may also be input to processor 121. The onboard processor may comprise a digital computer, or small dedicated processing unit that is capable of processing the data that is provided by the sensors 124 and the GPS unit 123.

A preferred onboard processor 121 will have sufficient processing capabilities to handle the tasks at hand, while being inexpensive enough to minimize additional costs. Additionally, onboard processor 121 should have appropriately low power draw requirements and should be designed to be ruggedized to operate in the often harsh outdoor environment in which vehicle computers operate. To that end, onboard computers such as processor 121 should preferably have a casing that is waterproof, dustproof and capable of withstanding temperature extremes.

Onboard processor 121 is in communication with a transceiver 122, which may be included as part of onboard processor 121. Transceiver 122 is designed to transmit data between the onboard processor 121 and some outside, near range data processing (computing and/or communications) portable device 125. It should be noted that the near range data processing portable device 125 may be referred to herein simply as "portable device 125" or "portable communication device 125" or "handheld computing device 125." Preferably, transceiver 122 transmits data to and receives data from the portable device 125 via either a Bluetooth signal or a Wi-Fi signal. Bluetooth and Wi-Fi type signals would not entail the expense of employing a "constant on" cellular phone line. It is also important that transceiver 122 be ruggedized to withstand the harsh environment in which a utility vehicle operates. Examples of such near range data processing devices include mobile devices that are held, carried or worn by the user, such as smartphones, smart watches, or various computing devices, such as tablets and the like, which can be incorporated into the vehicle or carried on the vehicle.

A portable communication device 125 can serve several major functions in connection with the communication system. The first function served by the portable communication device 125 is to receive information from the onboard processor 121. As many smartphones are capable of receiving each of Bluetooth, Wi-Fi and cellular phone signals, a smartphone can be employed to receive either a Bluetooth or Wi-Fi signal from transceiver 122 that is coupled to onboard processor 121. A second function served by portable communication device 125 is to serve as a processor, or adjunct processor for onboard processor 121.

One way in which the communications system can be configured is to employ a fairly sophisticated onboard processor that can process the data received by the sensors 124 and GPS unit 123, and then push the processed data onto the portable communication device 125 so that the portable communication device 125 can display and/or transmit the data without significant further processing. Alternately, the onboard processor 121 can be a less sophisticated processor whose primary duty is to receive information from the sensors 124 and GPS unit 123, and then to transmit it to the portable communication device 125. In such cases, the portable communication device 125 would perform the majority of the work in processing the raw data received by the sensors 124 and GPS unit 123 into a useable format for transmission or display. A third function performed by the portable communication device 125 is to serve as a display to enable the user to review the various parameters and data items that are being output to it by the onboard processor 121. In an alternate embodiment, a display screen is incorporated into the utility vehicle, in much the same manner that in-cabin touch screen displays exist on many automotive vehicles. However, one benefit of using the portable communication device 125 as a vehicle display is that you reduce the cost of the vehicle, and enable the communication system of the present application to be more easily and less expensively retro-fit onto existing vehicles. In this regard, it will be appreciated that many existing vehicles likely do not include displays. Therefore, the use of the portable communication device 125 for displaying the output data obviates the need for the user during a retrofit to mount a screen onto the utility vehicle.

In another embodiment, a function performed by the portable communication device 125 can be as a user interface to input data into the onboard processor 121. One example of such input data would include sending commands to the processor selecting which particular data set to display; or, to program the data processor to appropriately receive data from the sensors 124 that are provided on the utility vehicle.

In a further embodiment, a function served by the portable communication device 125 is to serve as a processor of data received by the portable communication device 125 from the onboard processor 121. Limitations in the onboard processor may require that the data processed by the onboard processor 121 and transmitted by the onboard processor 121 to the portable communication device 125 might be further processed in order to be in a user-friendly format. The processor within the portable communication device 125 may be capable of performing these more advanced processing functions.

In another embodiment, a function performed by the portable communication device 125 is to transmit data to a remote computer 126. The remote computer 126 may be located at the user's residence, or the utility vehicle owner's place of business, such as a fleet supervision center. By having the capability of transmitting the close-to-real time data from utility vehicle 100 to the fleet supervision center, supervisory personnel can monitor the operation and condition of utility vehicle 100 without being forced to travel out to the field to observe the utility vehicle. Additionally, the data transmitted to the fleet supervision center can enable fleet supervisors to better monitor the individual who is driving the lawnmower or utility vehicle, to thus help determine whether the employee is working or on a break; and, to also help determine the efficiency of the operator and other parameters relating to the operator's operation of utility vehicle 100.

Figure 3:
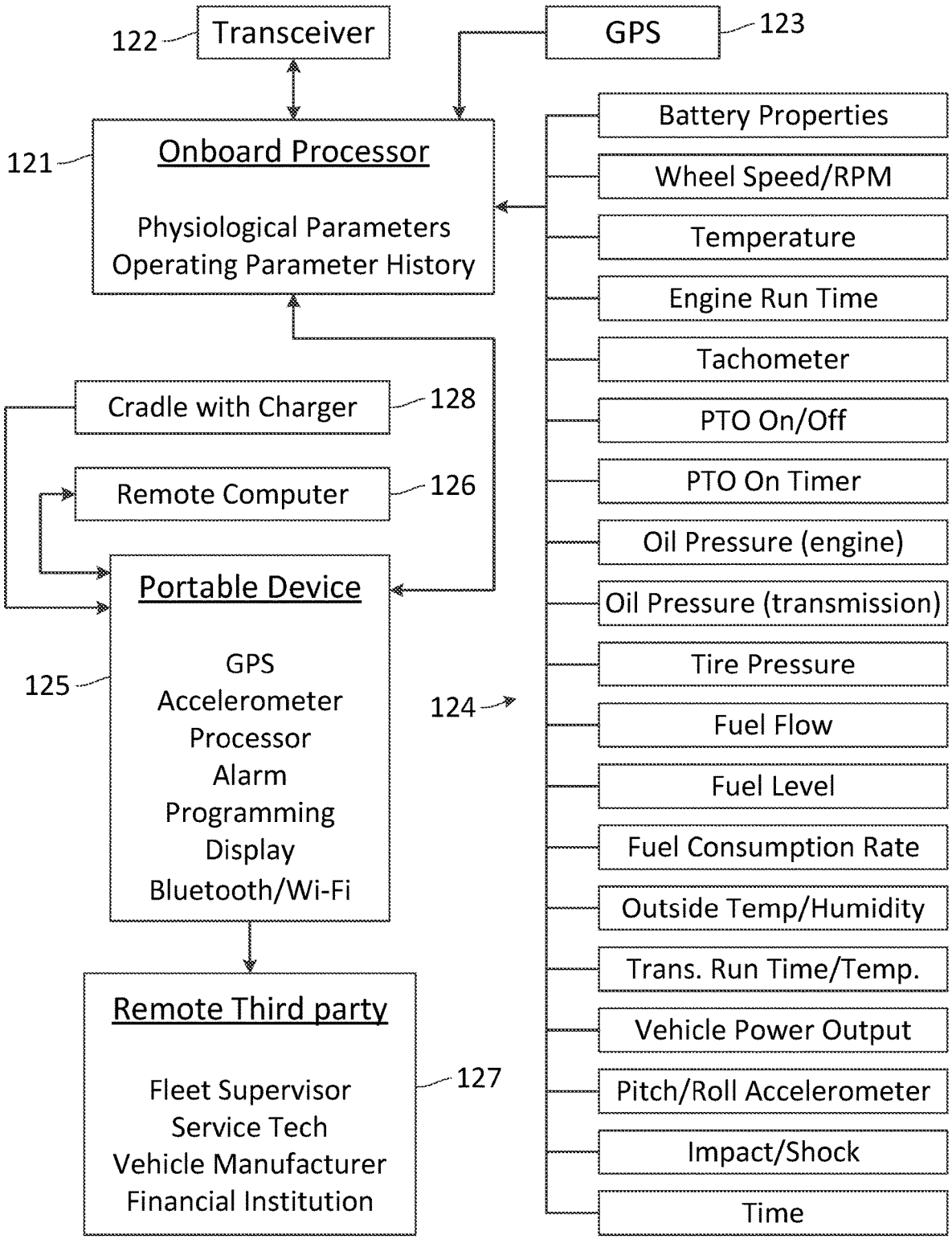
FIG. 3 is a diagram showing additional components of the monitoring system of FIG. 2 and including various input information that can be processed and transmitted to the monitoring system.

Turning now to FIG. 3, a schematic representation of the various inputs that can be processed and transmitted to and from the monitoring system is set forth. The utility vehicle 100 can include a plurality of sensors 124 for sensing various operation and condition parameters that relate to the utility device. One set of sensors can be related to battery operation including charge level and current draw. This sensor set can determine the level of charge of the battery and the current being drawn from the battery at any particular time. While battery charge level and current draw are applicable in many circumstances where a device includes a battery and electrical system, this information can be useful when one is operating a device with a hybrid drive system as described above.

Another useful sensor set measures wheel speed and RPM, providing valuable information about the speed variations of the vehicle. This information can be coupled with information from other sensors, such as a GPS device to provide geo-tracking data, to enable a supervisor or a software program monitoring the system to determine the particular speed of a vehicle in various areas for example of a lawn being mowed. By obtaining and processing these data, one can determine improved and more efficient work paths for an operator and a lawnmower on a particular plot of land on which the operator or mower is operating.

The plurality of sensors 124 can include a plurality of temperature sensors. These temperature sensors can monitor the temperatures of various components and/or fluids of the device such as water temperature, oil temperature, transmission fluid temperature and the like. Additionally, the temperature sensors can determine ambient temperature, temperature within the engine compartment, and the temperature of other important components such as processor 121 and controllers 120*a*, 120*b*.

As noted, the monitoring system can include a GPS unit 123 so that the location of vehicle 100 can be monitored. As discussed above in connection with the wheel speed data provided by an RPM sensor, the GPS and wheel speed data can be correlated to provide information about the speed at which the vehicle can operate in the various areas of a plot in which it is operating. With this information, a supervisor or a software program has the ability to determine ways to improve performance, such as by finding alternate routes at which the vehicle can operate more quickly, or monitoring the lawnmower operator to determine whether the operator is either moving too quickly to be operating safely, or too slowly to be efficient.

A sensor can also be provided to monitor engine run time. Engine run time is an important factor to monitor, as many maintenance functions are performed at particular engine run time intervals. For a utility vehicle such as a lawnmower, engine run time is the rough equivalent of miles driven in a motor vehicle such as a car, insofar as both are used as a measure of time that the device has been operating, and as such, are used to determine when certain maintenance functions should be performed on the device.

A tachometer or engine speed sensor can also provide valuable information about the operation of the device. For example, most engines tend to have an optimum operating speed, wherein the power delivered by the engine per unit of fuel used is optimized, or else a particular engine speed at which engine wear is reduced and durability increased for a particular engine. By comparing these desired parameters with actual engine speeds, one can gain insight into whether the engine is being operated efficiently, and whether the operator is operating the engine in an efficient operational range. For example, an overly high tachometer reading might suggest that the operator would be better served by running the device in a higher gear, or that the user is driving the device too quickly to be doing a careful job on the lawn being mowed.

A power take off (PTO) accessory on/off indicator and PTO accessory on/off timer sensors can provide indications about the operating parameters of the PTO accessory.

An oil pressure sensor is provided to determine whether the oil pressure within the engine is at a safe and acceptable range. An extremely low oil pressure can often be indicative of a shortage of oil, and shortage of oil can cause an engine to "seize up" and be ruined. As such, the ability to monitor the engine oil pressure is very helpful to maintain the health of the engine and prevent engine failure.

Similarly, a transmission oil pressure sensor can be provided. Similar to engine oil pressure, transmission oil pressure is an indicator of the health of the transmission, as an abnormally low transmission oil pressure can be indicative of an increased likelihood of failure of the transmission.

Tire pressure sensors can be monitored to ensure that the tires are properly inflated. Fuel flow and fuel level sensors can also be monitored. Fuel flow is monitored to determine the fuel consumption rate of the vehicle. The person monitoring the device benefits by having access to this information in determining whether the vehicle is operating efficiently. An abnormally high fuel flow rate may indicate that either the vehicle is being operated inefficiently or perhaps that the vehicle is in need of a filter replacement, spark plug changes and/or a tune-up that would help the vehicle to operate more efficiently. Fuel levels are important to monitor, to ensure that there is adequate fuel in the device to perform the job at hand and to help ensure that the operator of the vehicle does not run out of fuel in a position where the vehicle is far away from an available fuel source, such as a gas can.

A fuel consumption rate sensor is related to the fuel flow sensor, and helps to provide much of the information discussed above.

Another sensor can be capable of measuring an outside temperature and humidity. A further sensor is provided for measuring transmission run time and temperature. These parameters can be useful for determining maintenance schedules relating to the transmission, and also determining how well the transmission is operating. In one exemplary embodiment, an abnormally high temperature of the transmission is to be avoided as it will cause oil breakdown and possible seizing of the transmission. As such, the temperature sensor could be coupled to a "kill switch" to stop operation of the transmission if the temperature rises too high.

A vehicle power output sensor may be provided to measure the power output of the vehicle to determine its efficiency and the manner in which the vehicle is being operated.

An accelerometer can be provided for determining the pitch and roll and acceleration of the vehicle. It is helpful to monitor pitch and roll parameters to help determine both the operational efficiency of the vehicle and also the safety of the intended operation of the vehicle. For example, if a particular device has a maximum acceptable roll angle of 15 degrees from horizontal, the indication by an accelerometer that the vehicle is being operated above that angle would suggest that the vehicle is being operated outside its preferred safety range.

For a lawnmower, the monitor and operator may wish to discuss alternate mowing paths wherein the grass to be mowed can still be mowed without the lawnmower operating outside the safety range. For example, if driving the mower along the side of a hill causes the device to lean over past its acceptable roll point, the monitor can instruct the user to operate the device by driving up and down the hill, rather than sideways around the hill. Driving up and down the hill may be safer as the device might be more stable over a greater angle when moving up and down a hill than sideways around it. Alternately, there may be some hill areas that are too steep to mow with a riding lawnmower safely either sideways around the hill or vertically up and down the hill and, as such, should be cut with equipment that is designed for handling such steep hills.

A time sensor may be employed to feed data into onboard processor 121. The time sensor can be used to provide information relating to the time of operation of the vehicle. This timer might include not only the elapsed time during which the vehicle is operated, but also the time period in which it operates. By knowing the time periods in which the vehicle operated (e.g. between 10:00 a.m. and 12:30 p.m.), the monitor can better determine the efficiency of the worker. For example, if a particular worker is supposed to be operating the vehicle on an eight hour basis, but it is shown by the timer that the vehicle was actually operating for only six hours, the person monitoring the situation can deduce that the worker was not performing his expected function during the two hour period in which the lawnmower was not being driven.

Another parameter that can be monitored by sensors is impact or shock. Impact or shock is useful to monitor to determine whether the utility vehicle was engaged in an accident such as by hitting something, or alternately, could denote rough terrain over which the vehicle was being driven. An indication of an accident might suggest that the operator be contacted to determine whether the operator was injured or the vehicle was damaged as a result of the accident. An indication of rough terrain may suggest that the speed of the vehicle should be lowered to reduce the jarring on the user as the vehicle rides over the rough terrain.

The various parameters discussed above can be fed into onboard processor 121, which then processes the information and transfers it to a near range display and transmitting device, such as a portable device 125. As shown in FIG. 3, the portable device 125 can have a GPS and an accelerometer. The use of a GPS and an accelerometer on the portable device 125 would obviate the need for an accelerometer and GPS unit 123 to be installed on the vehicle. Many portable devices such as smartphones and tablets, already have GPS capability and accelerometers.

A major purpose served by the handheld computing device 125 is use as a display, processor and programming device. Current smartphones and tablets include significant processing capability. As such, the processing capability of a smartphone and tablet may enable the fleet operator to use a less expensive, less sophisticated onboard processor for the vehicle, and to employ the processor in the handheld computing device to perform the processing tasks, rather than the onboard processor 121. As such, the onboard processor 121 could be a processor that does little more than receive the input data from the sensors 124, and transmit it via Bluetooth or Wi-Fi to the portable device 125. The portable device's processor could then process the information into useable reports and displays, and also correlate various parameters, such as speed and GPS, to provide other useful information to the user.

One way to display the information that is gathered by the sensors 124 and processed by the onboard processor 121 is to provide an onboard display (not shown) that is placed on a dashboard or stalk (not shown) that is affixed to the device. Although such a display could be employed on a lawnmower, the need to have the display ruggedized to withstand the harsh conditions normally encountered by the lawnmower, such as rain, snow and the like, would add to the cost of the display. Additionally, many older vehicles exist that do not include displays, but that already include electronic sensors, that could, through the application of a suitable processor and programming, be capable of forwarding information from the lawnmower to a portable device for display. On such older vehicles, it might be cost prohibitive to retro-fit the vehicle with the display screen and therefore might be more cost-effective to rely on the display screen that is already contained within the portable device 125.

One form of display that the portable device 125 can include is an alarm display. For example, if the oil pressure gets too low, or the transmission temperature gets too high, or some other parameter that is being measured operates outside of a normal acceptable range, the display can be designed to cause an alarm tone to ring, for example. The alarm display can send a warning signal and display a message such as "stop—low oil pressure" on the portable device display to thus warn the operator of an impending problem with the vehicle or work device.

To make the display visually accessible to the user, the vehicle can include a cradle 128 for holding the portable device 125. Cradle 128 is preferably positioned somewhere within the user's normal operative viewing area, so that the user can view the display while operating the lawnmower without taking his eyes and focus away from the area which he is mowing. Preferably, any such cradle 128 includes a charger to help charge the portable device 125 so that it does not run out of power while being used.

A further desirable feature of the handheld computing device is the ability to use the handheld computing device as a programming tool. As such, the handheld computing device 125 can transmit information to the onboard processor 121, to either program the processor to perform certain functions relating to the sensors 124 or the transmission of the sensed information; or alternately, to set operational parameters of vehicle 100.

In another embodiment, a near range portable device 125 is capable of transmitting its information to a remote data processor/display device. One such far range electronic device can include a remote computer 126 that is, for example, at a user's home or at a company office wherein supervisory or monitoring personnel can monitor the parameters of the various vehicles being used. Alternately, the information can be transmitted to a third party remote site 127 such as a service technician. For example, a company might either have a service department or contract its maintenance to a third party service facility. By enabling the service facility to receive information from vehicle 100, the service facility can better diagnose problems with the vehicle and can anticipate service needs. For example, if a service facility receives information that a particular vehicle has "out of normal range" fuel consumption rate, a service technician may ship a fuel filter to the owner to enable the owner to change the fuel filter and thereby potentially adjust the fuel consumption rate.

Alternately, information about a utility vehicle relating to its operational time can alert the third party service facility that the particular utility vehicle has reached a service milestone, and therefore, to expect that the utility vehicle will be delivered to the service facility for a particular type of service. For example, if the oil in the utility vehicle must be changed every 300 hours, the data transmission from the utility vehicle to the service tech that the device has been in operation for 290 hours will alert the service tech that the vehicle will soon be in need of an oil change, therefore signaling the service organization to reserve time and supplies for the utility vehicle's needed service.

Another data stream can comprise data akin to a "black box" that may include material relating to the operational parameters of the vehicle that includes information similar to what one might have on the flight recorder of an airplane.

Figure 4:
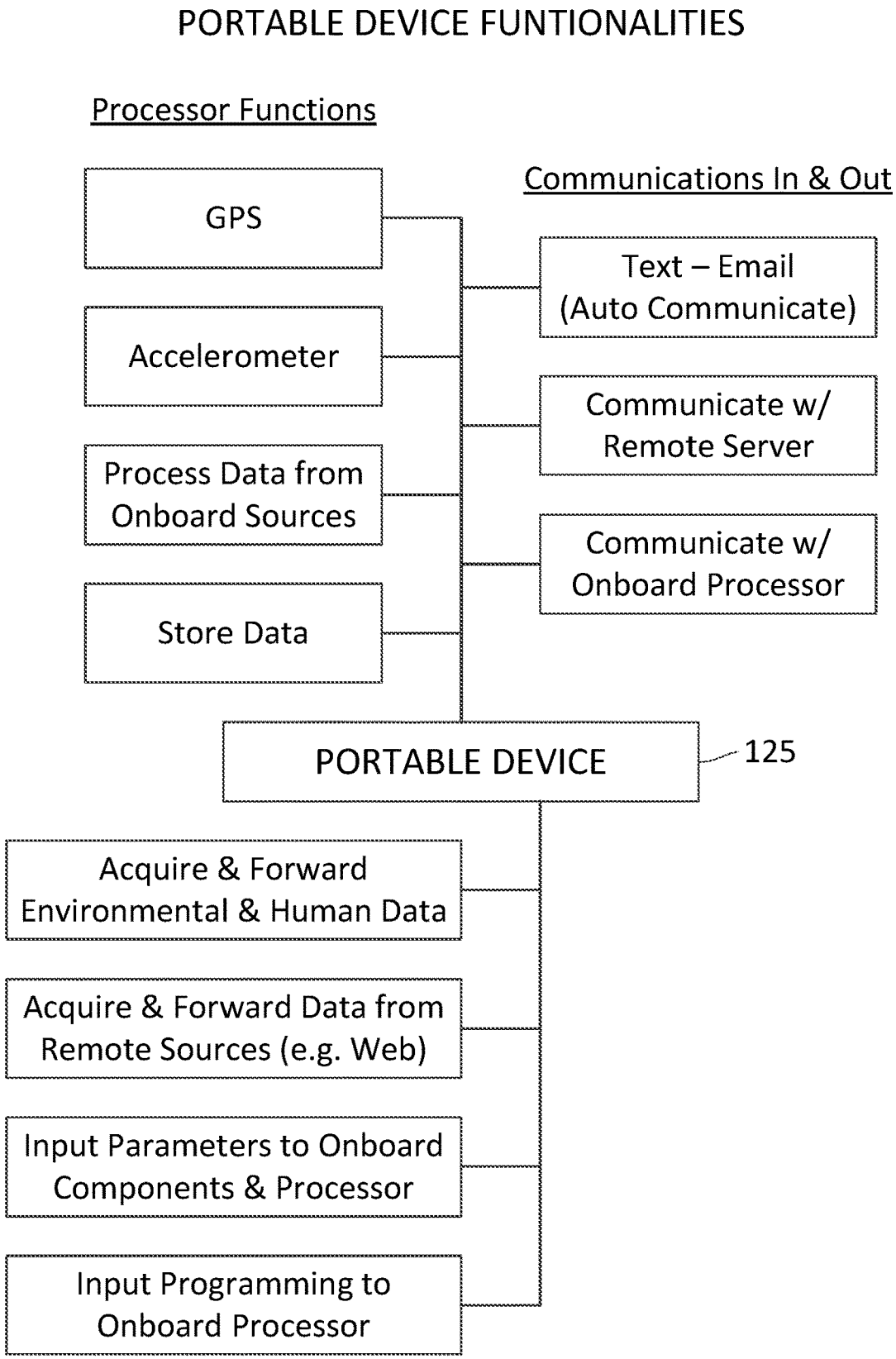
FIG. 4 is a diagram of various functionalities provided by a near range electronic device, such as a portable communication device employed in a monitoring system.

The various functionalities of a portable device 125 are discussed in connection with the diagram of FIG. 4. The portable device can include GPS functionality for determining the location of the user and the particular vehicle being operated by the user. As discussed above, the portable device 125 can include an accelerometer. By fixedly coupling the portable device 125 to the vehicle, such as by putting the portable device 125 in a cradle 128, and by orienting the portable device 125 relative to the particular vehicle, the accelerometer on the portable device 125 can be used to determine the pitch and roll of the vehicle, so that one will know whether the vehicle is traveling uphill or downhill, or along the side of the hill. Additionally, from the accelerometer data, one can determine the grade the vehicle is traversing up or down, or the grade of the hill along the side of which the vehicle is proceeding.

Another functionality served by the portable device 125 is the use of the portable device's processor for processing data from the onboard processor 121. The onboard processor 121 can process information that it receives from the sensors 124, and forward that information to the portable device 125. The processor of the portable device 125 can process these data into a form that is easily useable by supervisory personnel and the vehicle operator. Additionally, the data can be processed into a form where it can be used in the creation of reports.

The data storage capabilities of a portable device such as handheld computing device 125 can be used to store operational data about vehicle 100. With a handheld computing device's limited data storage capabilities, it is contemplated to store large amounts of data not on portable device 125, but remotely, on a computer or server at the company's office or at the home of the user.

In another embodiment, the functionality of a portable device 125 can include an ability to send messages via, for example, text message and e-mail. These texts and e-mails can comprise messages that are forwarded to third parties. In a particular example, a report from the onboard sensor and processor of a lawnmower that the vehicle has achieved a certain operational time milestone (e.g. 300 hours) can cause the portable device 125 to communicate via text or e-mail to a service facility to tell the service facility that the lawnmower will be in for service soon. The message can indicate that the service facility should be prepared to perform whatever milestone service activities are suggested for the lawnmower at the particular milestone. Additionally, the portable device can have communication capabilities that enable it to communicate with a remote server. The remote server can be a server that is in "the cloud" or otherwise at the user's location. For companies that operate a fleet of devices, the remote server can be a server that is accessible to management.

A data stream transmitted to a server can be further processed by a remote server to prepare reports of the type desired by management or a user. Additionally, the data results produced by the remote server can be stored on the remote server to serve both as back-up for the portable device and as expanded storage capabilities to the portable device.

The portable device includes capabilities for communicating with onboard processor 121. In an embodiment with a smartphone device and to save valuable mobile phone "airtime minutes," the phone should be designed to communicate with the onboard processor 121 via a Bluetooth or Wi-Fi communication protocol that is much less expensive than a telephone protocol. For handheld computing devices such as a tablet, Bluetooth and Wi-Fi can be used for transmission between onboard processor 121 and the tablet and between the tablet and remote facilities. Additionally, cellular data transfer can be used for communication between the tablet and remote facilities. The smartphone can also be capable of acquiring data to process and prepare reports for display; or can transfer and communicate the acquired data or reports through remote facilities, such as a remote server.

A monitoring system of a further embodiment can be used to acquire and forward environmental and human data. For example, medical sensors such as heart rate sensors, blood oxygen sensors and the like can be functionally attached to a human operator. The sensor data from the human operator can be picked up by the handheld computing device, transmitted into the handheld computing device, processed by the handheld computing device and then either displayed to the user or transmitted to a remote data processor such as a medical facility or operation center. With this, the health condition of a user can be monitored. Additionally, a handheld computing device can be capable of acquiring data from a remote source such as a website, and also forwarding data to remote sources, such as the website, and the like.

Website data that one might wish to acquire includes information such as geo-location data, so that the user can find the location of his next job. Additionally, the user may seek to acquire weather related data so that the user will be forewarned of hazardous weather such as lightning, storms and tornadoes, and will also be warned of the approach of a rain storm if the presence of rain prevents the user from operating the vehicle.

The portable device 125 can further be used as a means for inputting parameters into the onboard components causing the onboard components to operate in a manner that is desired by the operator, such as the aggressiveness of vehicle responses. Further, portable device 125 can be used to input programming into onboard processor 121 to provide programming for processor 121 to process information from sensors 124, or to provide specialized processing for onboard processor 121. For example, the addition of a new sensor may require adding a new program to onboard processor 121 to allow onboard processor 121 to read the data being provided by the new sensor.

Figure 5:
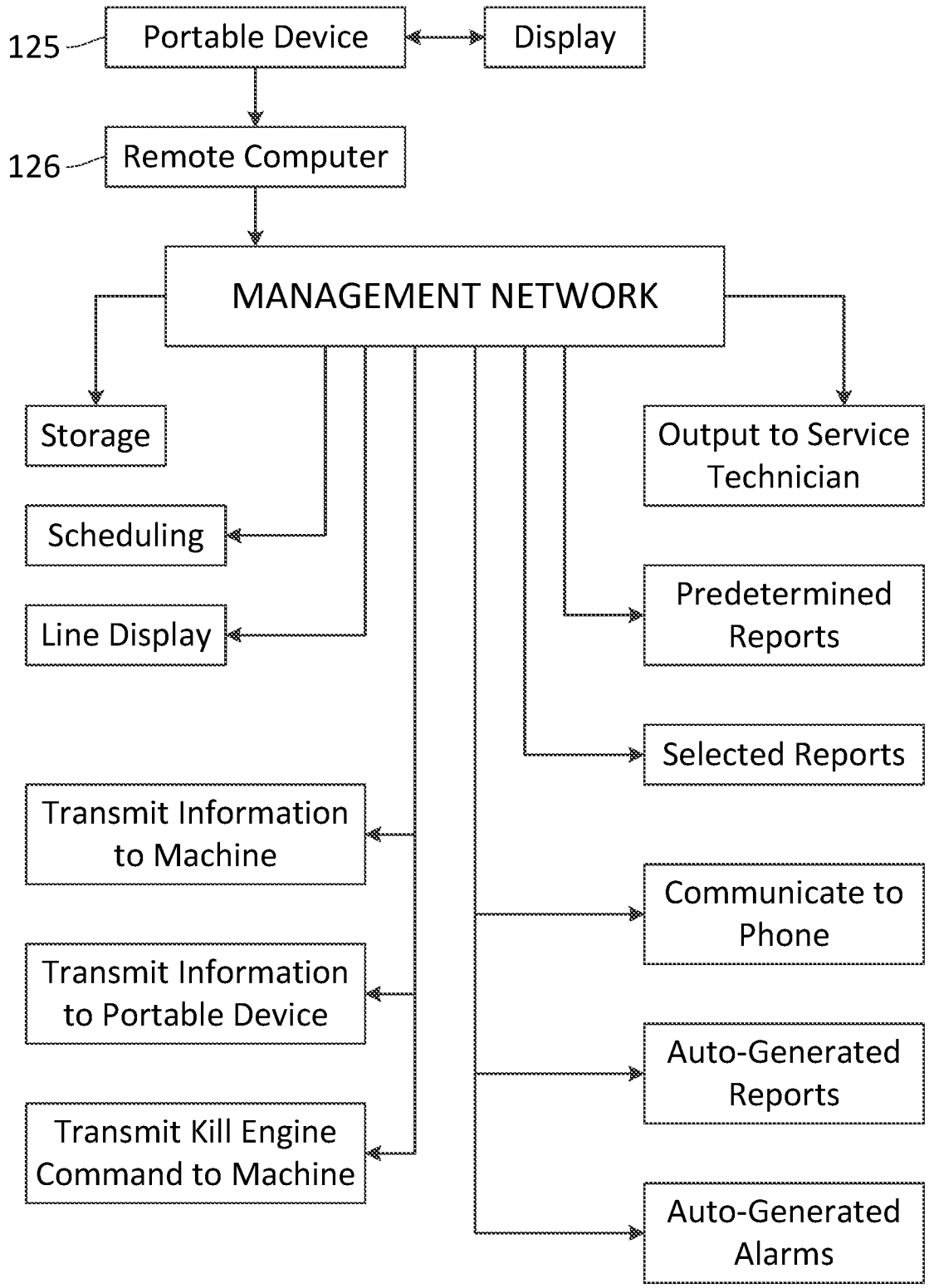
FIG. 5 is a diagram of various outputs achievable with information processed and transmitted by a monitoring system.

Turning now to FIG. 5, the various outputs that may be provided by a portable device 125 are discussed. It is understood that the data output by portable device 125 can include that information, as discussed above, that the portable device 125 receives from a vehicle 100 and sensors 124. Additionally, the information transmitted can include data the portable device 125 acquires on its own through a GPS, an accelerometer, and other sensors. Other sensors may be in direct communication with portable device 125. The data that the portable device 125 is forwarding onward can include things such as the current or expected weather data received from a web-based source, or from weather-based sensors on vehicle 100, so that those located remotely monitoring the operation of the vehicle 100 will know for example that it is raining or other inclement weather may exist affecting the performance of the operator or the vehicle.

The portable device 125 can be capable of transmitting information to a remote computer 126. As discussed above, remote computer 126 can be at a user's residence or at a place of business of a company operating a device. The discussion in connection with FIG. 5 can be made in the context of an embodiment where the information being transferred to a remote computer 126 is used by an operator of a fleet of lawnmowers, wherein the fleet operator needs to monitor the operation of several lawnmowers within the fleet. Although the discussion is set in this context, it is appreciated that various information and reports that are produced could also be valuable to an individual user.

In a further embodiment, a remote computer 126 receives data and transmits it to a management network that is accessible by appropriate management personnel within a company. The management network may itself be programmed to transfer the data to a third party source, such as a service technician. Although the service technician can be a third party service technician under contract to the company, it may be a technician directly employed by the company.

In this regard, data can be output to service technicians generally, or to specific service technicians, if, for example, certain service technicians are tasked to fix and repair certain units of a fleet; or alternatively, if certain technicians are tasked to perform certain mechanical tasks for all members of the fleet. In another example, a particular transmission sensor on a lawnmower may detect that a transmission is running hot, thereby suggesting that the transmission is in need of repair. This sensed data may then be transmitted to onboard processor 121, which will then automatically transmit the sensed data to a portable device. The sensed data will then be automatically transmitted from the portable device to a management network. If a service provider has a particular technician who is a transmission specialist, the information can be forwarded directly to that specialist, so that he or she can diagnose the problem remotely and notify the operator that a quick fix is available, or signal the operator that the lawnmower is in need of immediate repair, or schedule a repair for the lawnmower and, if possible, acquire whatever parts and tools are necessary to perform the needed repair.

From a management network, various types of displays and reports can be provided. The information that comes into the management network can be displayed on a real time basis as it occurs. Additionally, predetermined reports can be provided to management personnel. For example, the data that the management network acquires from a fleet of lawnmowers can include information relating to the time periods during which the lawnmowers were operational and the times during which the blades of a lawnmower were operational. From this data, an exemplary report could be prepared that would list the various operational times for all of the various lawnmower operators to better help management personnel determine which operators were working efficiently and which operators were less efficient. Additionally, various management members may decide to have customized reports prepared that would provide them with information that they specifically request.

A management network is also capable of communicating information to portable devices so that, for example, a foreman in the field can have operational data forwarded to him about the particular units and operators that he is supervising. Additionally, auto-generated communication reports can be transmitted by the management network to both management personnel and to the operators in the field to provide needed updates and data, such as data telling the workers that their paychecks are now available for deposit.

Additionally, the management network computers can be designed to provide auto-generated alarms if certain parameters are sensed. These auto-generated alarms are intended to give warnings to operators, supervisors, other field personnel and management personnel that particular conditions exist that require immediate attention.

Additionally, the management network can be capable of transmitting other information. For example, the network can acquire data from the vehicles, process the data, and then based on the data processed, transmit information to the vehicles. For example, if a "run-away" situation is encountered where a vehicle is operating erratically, it is possible for the management network to transmit a "kill" signal to cause the vehicle to shut off before its movement causes injury to a third party or damage to the machine. The management network can remotely modify vehicle parameters in the event that vehicle components are compromised. For example, if the alternator is not performing properly, the vehicle's speed can be limited and an appropriate notice to the operator can be generated. Additionally, a management network can transmit information to an operator, such as informing the operator of his next job, transmitting a "well done" message to the operator, or transmitting a message relating the need for corrective action, such as telling the operator to work more efficiently if he is not performing his duties up to expected levels. The interactions above can be initiated by the management network automatically or by a supervisor monitoring the management network.

A kill signal can also be transmitted to the vehicle 100 in response to GPS related information that suggests the vehicle has been stolen. By sending a kill signal to the vehicle, the vehicle may be incapable of being started or moved, thus making recovery of the vehicle easier.

A management network can send data to be stored in either a backup or cloud-based storage system. Data from the storage server can be retrieved by the management network if management personnel desire to use the stored data to produce reports or better understand the operation of a device.

A management network can also use the acquired information to plan future actions. For example, by knowing the time during which a device is being used, management can better schedule a device to optimize use. If the time of operation data received from the vehicle indicates that the vehicle is only being used for five hours during an eight hour shift, management can use this information to add one or more additional tasks to the particular operator's schedule, so that use of the device is optimized.

Having described the invention in detail with reference to certain preferred embodiments, it will be appreciated that variations and modifications exist within the scope and spirit of the present application.

What is claimed is:

1. A drive and monitoring system for controlling and monitoring operation of a mower, the drive and monitoring system comprising:

a first electric transaxle driving a first driven wheel and a second electric transaxle driving a second driven wheel;

a first traction controller operatively connected to the first electric transaxle;

a first drive lever connected to a first control assembly, wherein the first control assembly is operatively connected to the first traction controller and communicates a position of the first drive lever to the first traction controller;

a second traction controller operatively connected to the second electric transaxle;

a second drive lever connected to a second control assembly, wherein the second control assembly is operatively connected to the second traction controller and communicates a position of the second drive lever to the second traction controller;

a power take off disposed on the mower and comprising a plurality of blades for cutting grass or other vegetation;

an onboard processor in communication with the first control assembly and the second control assembly, the onboard processor comprising a transceiver configured to communicate with a mobile device via a wireless personal area network (WPAN); and a far range electronic device configured to:

communicate with the mobile device via a cellular network to receive, in real-time, GPS location data collected from a GPS unit of the mobile device;

determine, in real-time, a travel speed of the mobile device based on the GPS location data;

determine, in real-time, a command signal for the mower based on the travel speed of the mobile device; and transmit, in real-time, the command signal to the onboard processor via the mobile device to instruct the onboard processor to modify one or more mower operational parameters.

2. The drive and monitoring system of claim 1, wherein, if the GPS location data corresponds with erratic driving behavior, the far range electronic device is configured to include a kill signal in the command signal to instruct the onboard processor to stop at least one of an internal combustion engine and an electric motor.

3. The drive and monitoring system of claim 1, wherein a GPS device is not integrally installed onto the mower.

4. The drive and monitoring system of claim 1, wherein the far range electronic device is configured to receive, via the cellular network, accelerometer data collected from an accelerometer of the mobile device.

5. The drive and monitoring system of claim 4, wherein the command signal transmitted by the far range electronic device is further based on the accelerometer data.

6. The drive and monitoring system of claim 4, wherein the accelerometer data includes pitch data, roll data, and acceleration data.

7. The drive and monitoring system of claim 1, wherein the one or more mower operational parameters to be modified by the command signal includes a speed limitation of the mower.

8. The drive and monitoring system of claim 1, further comprising a battery and a cradle disposed on the mower, wherein the cradle is configured to support the mobile device and includes a charger in communication with the battery to charge the mobile device.

9. A system for remotely controlling lawn mower operations, the system comprising:

a lawn mower comprising:

a plurality of wheels;

a plurality of blades for cutting vegetation;

a battery;

a cradle configured to support a mobile device, the cradle including a charger connected to the battery and configured to charge the mobile device;

an onboard processor configured to control operation of the lawn mower; and a transceiver configured to communicate with the mobile device via a wireless personal area network (WPAN); and a remote server configured to:

communicate with the mobile device via a cellular network to receive, in real-time, GPS location data collected from a GPS unit of the mobile device;

determine, in real-time, a travel speed of the mobile device using the GPS location data collected from the mobile device;

determine, in real-time, a command signal for the lawn mower based on the travel speed of the mobile device; and transmit, in real-time, the command signal to the onboard processor via the mobile device to instruct the onboard processor to modify one or more mower operational parameters.

10. The system of claim 9, wherein the lawn mower further comprises:

a first electric transaxle driving a first of the plurality of wheels;

a first traction controller operatively connected to the first electric transaxle;

a first drive lever; and a first control assembly connected to the first drive lever and operatively connected to the first traction controller, wherein the first control assembly is configured to communicate a position of the first drive lever to the first traction controller.

11. The system of claim 10, wherein the lawn mower further comprises:

a second electric transaxle driving a second of the plurality of wheels;

a second traction controller operatively connected to the second electric transaxle;

a second drive lever; and a second control assembly connected to the second drive lever and operatively connected to the second traction controller, wherein the second control assembly is configured to communicate a position of the second drive lever to the second traction controller.

12. The system of claim 9, wherein the lawn mower further comprises at least one of an internal combustion engine and an electric motor, and wherein, if the GPS location data corresponds with erratic driving behavior, the remote server is configured to include a kill signal in the command signal to instruct the onboard processor to stop the at least one of the internal combustion engine and the electric motor.

13. The system of claim 9, wherein a GPS device is not integrally installed onto the lawn mower.

14. The system of claim 9, wherein the remote server is configured to receive, via the cellular network, accelerometer data collected from an accelerometer of the mobile device.

15. The system of claim 14, wherein the remote server is configured to determine the command signal further based on the accelerometer data of the mobile device.

16. The system of claim 15, wherein the accelerometer data includes pitch data, roll data, and acceleration data.

17. The system of claim 9, wherein the one or more mower operational parameters instructed to be modified by the command signal includes a speed limitation of the lawn mower.

18. The system of claim 9, wherein the lawn mower further comprises a sensor configured to acquire operational data of the lawn mower, wherein the transceiver is configured to transmit, in real-time, the operational data to the remote server via the mobile device, and wherein the remote server is configured to determine the command signal further based on the operational data of the lawn mower.

* * * * *